US008025521B2

(12) United States Patent
Diniz et al.

(10) Patent No.: US 8,025,521 B2
(45) Date of Patent: Sep. 27, 2011

(54) ELECTRICAL CONNECTOR

(75) Inventors: Milton Egas Diniz, Braganca Paulista (BR); Luiz Roberto Savedra, Guarulhos (BR)

(73) Assignee: Hubbell Incorporated, Shelton, CT (US)

( * ) Notice: Subject to any disclaimer, the term of this patent is extended or adjusted under 35 U.S.C. 154(b) by 237 days.

(21) Appl. No.: 12/473,592

(22) Filed: May 28, 2009

(65) Prior Publication Data

US 2010/0003846 A1 Jan. 7, 2010

Related U.S. Application Data

(60) Provisional application No. 61/133,713, filed on Jul. 1, 2008.

(51) Int. Cl.
*H01R 4/24* (2006.01)

(52) U.S. Cl. ..... 439/395; 439/781; 439/431

(58) Field of Classification Search ..... 439/395, 439/806, 432, 815, 781, 431
See application file for complete search history.

(56) References Cited

U.S. PATENT DOCUMENTS

| | | | | |
|---|---|---|---|---|
| 4,985,003 | A | 1/1991 | Francois et al. | 439/781 |
| 5,015,198 | A * | 5/1991 | Delin | 439/411 |
| 5,704,816 | A | 1/1998 | Polidori | 439/781 |
| 5,944,463 | A * | 8/1999 | Savage, Jr. | 439/419 |
| 6,086,406 | A | 7/2000 | Francois et al. | 439/402 |
| 7,766,687 | B2 * | 8/2010 | Verjans et al. | 439/404 |

FOREIGN PATENT DOCUMENTS

BR 0200237 10/2003

* cited by examiner

*Primary Examiner* — T C Patel
*Assistant Examiner* — Travis Chambers
(74) *Attorney, Agent, or Firm* — Harrington & Smith

(57) ABSTRACT

An electrical connector including a first connection section adapted to connect to a first electrical conductor; and a second connection section adapted to connect to a second electrical conductor. The first and second connection sections include a first member, a second member and a compression member for compressing the second member towards the first member. The second member is pivotably connected to the first member at a rotating pivot which is spaced from the compression member and the second connection section.

18 Claims, 16 Drawing Sheets

ELECTRICAL CONNECTOR

CROSS REFERENCE TO RELATED APPLICATION

This application claims priority under 35 U.S.C. §119(e) on U.S. Provisional Patent Application No. 61/133,713 filed Jul. 1, 2008 which is hereby incorporated by reference in its entirety.

BACKGROUND OF THE INVENTION

1. Field of the Invention

The invention relates to an electrical connector and, more particularly, to an electrical connector for connecting multiple conductors to a main conductor.

2. Brief Description of Prior Developments

U.S. Pat. No. 4,985,003 discloses an electrical connector with a nut and bolt for compressing two jaws together. U.S. Pat. No. 5,704,816 discloses a hinged electrical connector having a nut and bolt connecting two jaw members.

SUMMARY

The following summary is merely intended to be exemplary. The summary is not intended to limit the scope of the claimed invention.

In accordance with one aspect of the invention, an electrical connector is provided including a first connection section adapted to connect to a first electrical conductor; and a second connection section adapted to connect to a second electrical conductor. The first and second connection sections include a first member, a second member and a compression member for compressing the second member towards the first member. The second member is pivotably connected to the first member at a rotating pivot which is spaced from the compression member and the second connection section.

In accordance with another aspect of the invention, an electrical connector is provided comprising a first member and a second member. The first member comprises a first end and a second end. The first member comprises a metal plate with insulation piercing teeth at the first end for connection to a first conductor and a second conductor connection section at the second end. The second end comprises a pivot post extending from the second end. The second member is rotatably connected to the first member on the pivot post. The second member is adapted to press the first conductor into the teeth of the metal plate.

In accordance with another aspect of the invention, an electrical connector is provided comprising a first connection section adapted to connect to a first electrical conductor; and a second connection section adapted to connect to a second electrical conductor. The first and second connection sections comprise a first member, a second member pivotably connected to the first member, and a compression member for compressing the second member towards the first member. The second member is adapted to compress the first conductor against the first member. The first member is adapted to connect to the second electrical conductor without the second member contacting the second conductor.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENTS

Figure 1:
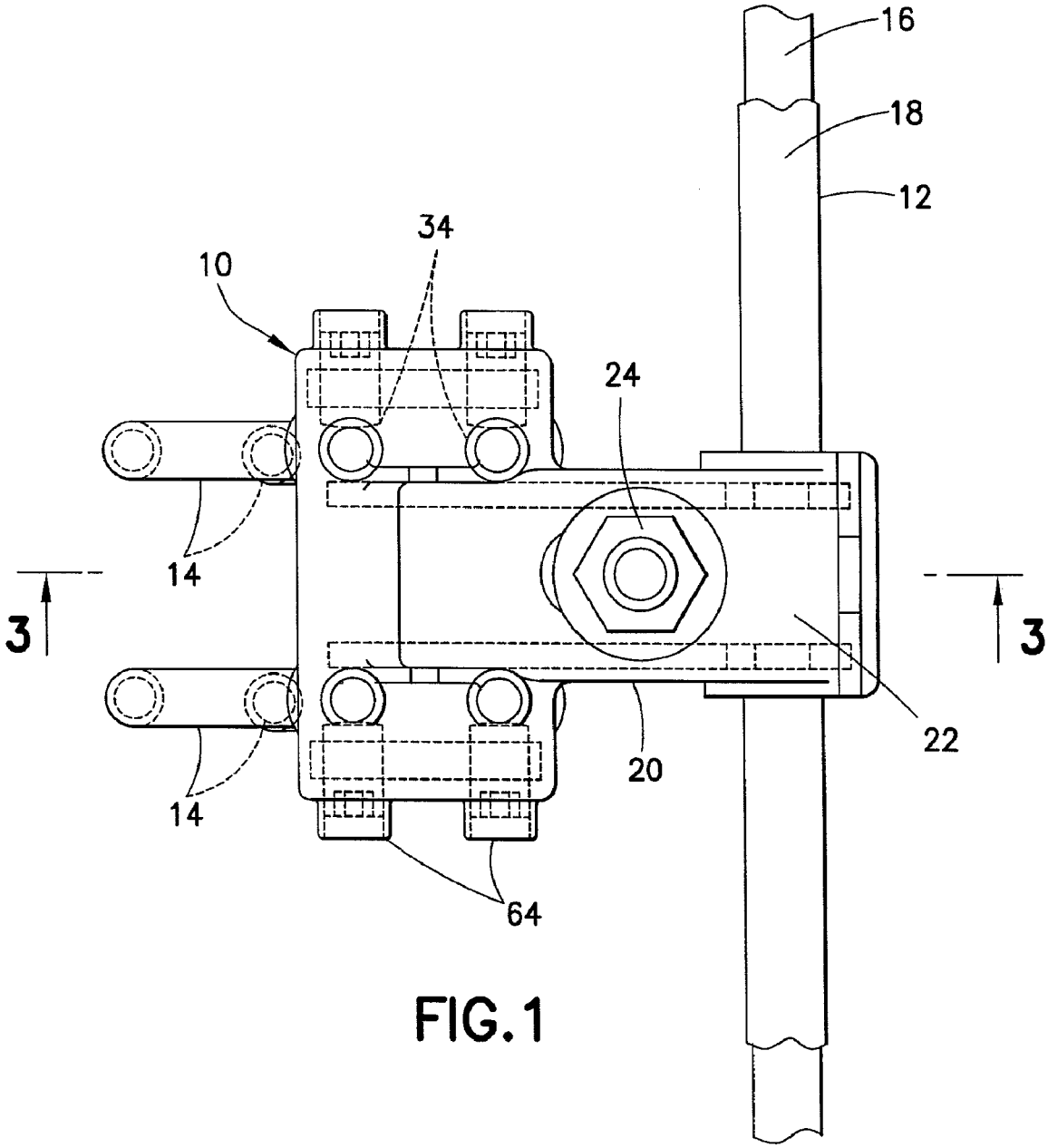
FIG. 1 is a top plane view of one embodiment of the invention shown attached to first and second conductors.
Figure 2:
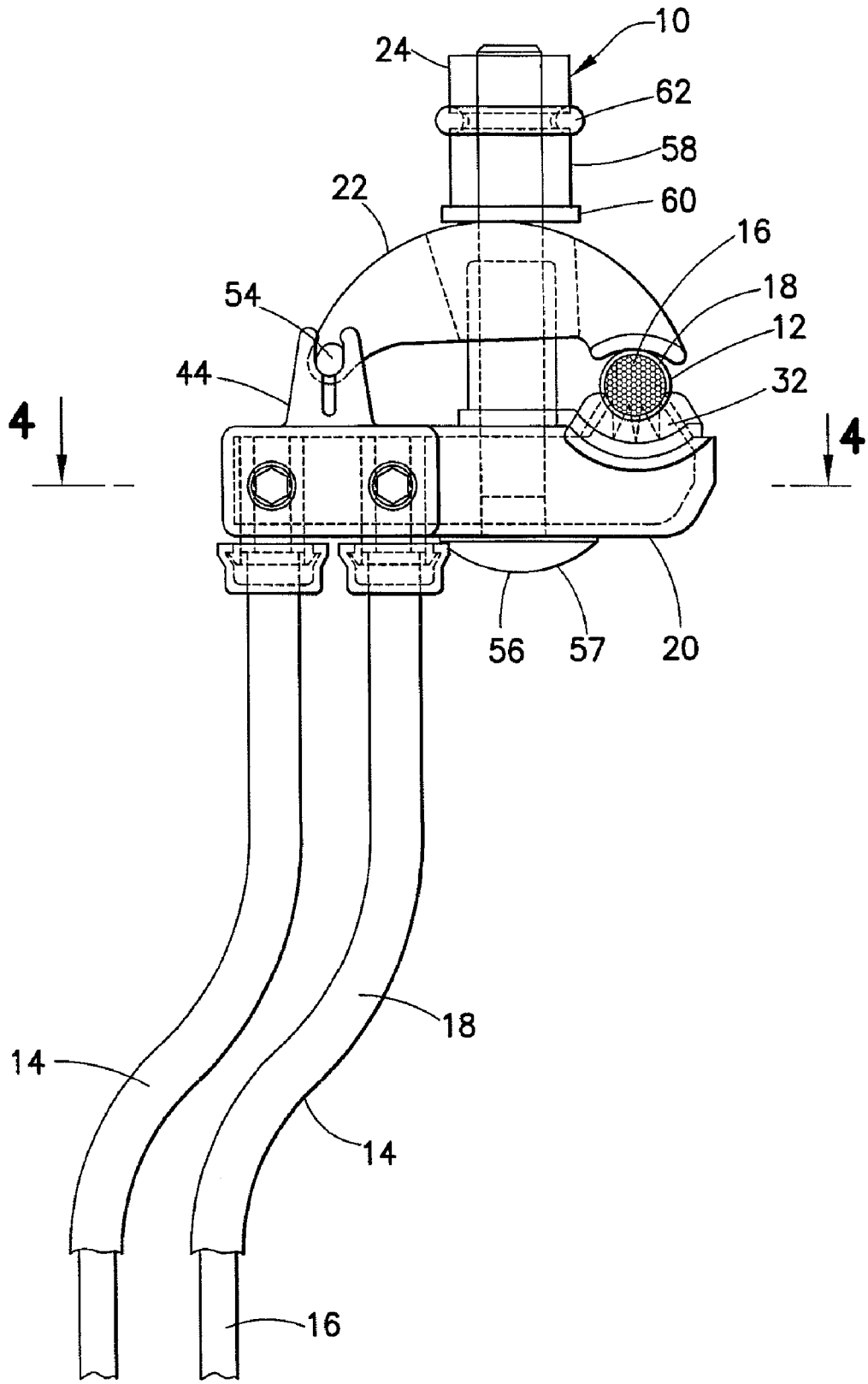
FIG. 2 is a side view of the electrical connector and electrical conductors shown in FIG. 1.

Referring to FIGS. 1 and 2, there is shown an electrical connector 10 incorporating features of the invention. Although the invention will be described with reference to the example embodiments shown in the drawings, it should be understood that the invention can be embodied in many alternate forms of embodiments and concepts of electrical contacts. In addition, any suitable size, shape or type of elements or materials could be used.

The connector 10 is configured to connect tap conductors 14 to a main conductor 12. The main conductor 12 could be a cable in a power distribution system for example. The main conductor 12 includes an electrically conductive core 16 (such as wound conductor strands for example) and outer electrical insulation 18. The tap conductors 14 each also include an electrically conductive core 16 (such as wound conductor strands for example) and outer electrical insulation 18.

The connector 10 generally comprises a first member or jaw 20, a second member or jaw 22, and a compression connector 24. Referring also to FIGS. 3-6, the first member 20 comprises a first end 26, an opposite second end 28, and a hole 30 between the two ends 26, 28. A top side of the first end 26 has insulation piercing teeth 32 arrange in a channel. The teeth 32 form a first connection section. The middle section has a post 31 extending from the top side. The hole 30 extends through the post 31. The second end 28 has conductor receiving holes 34 extending into a bottom side of the second end 28. Threaded holes 36 intersect with the holes 34. The threaded holes 36 extend into two opposed lateral sides of the second end 28. A top side of the second end 28 has two upward extending, laterally spaced pivot posts 44. Each post 44 has a pivot pin receiving area in its top side.

Figure 4:
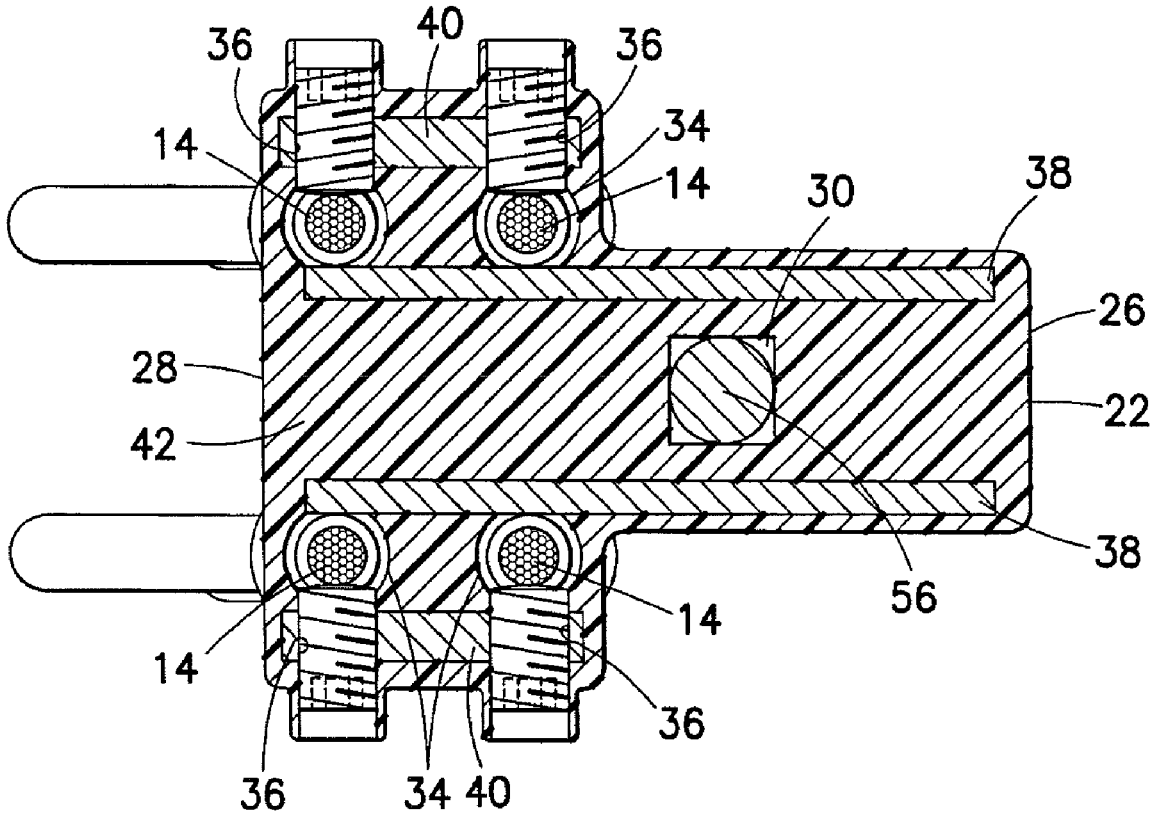
FIG. 4 is a cross sectional view taken along line 4-4 of FIG. 2.
Figure 5:
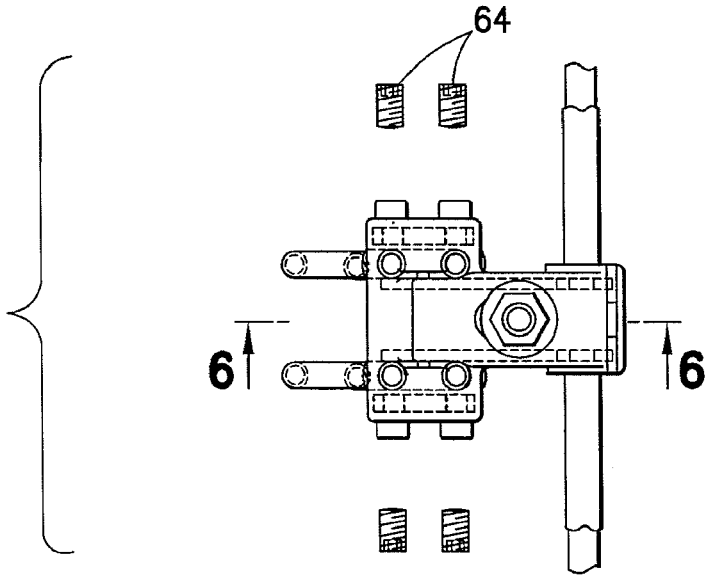
FIG. 5 is a plane top view of an alternate embodiment of the invention.

In this embodiment, as best seen in FIG. 4, the first member 20 comprises metal plates 38, 40 and an overmolded body 42 of plastic material. The plates 38 have the teeth 32 at one end and intersect the holes 34 at an opposite end. The teeth 32 of the first plate 38 are generally spaced and parallel to the teeth 32 of the second plate 38. The plates 40 form fastener plates with the threads for the holes 36. The holes 34 are generally orthogonal to the holes 36, and are located between one of the conductor plates 38 and one of the fastener plates 40 at each lateral side. However, in an alternate embodiment any suitable arrangement of members could be used to form the first member 20.

Figure 3:
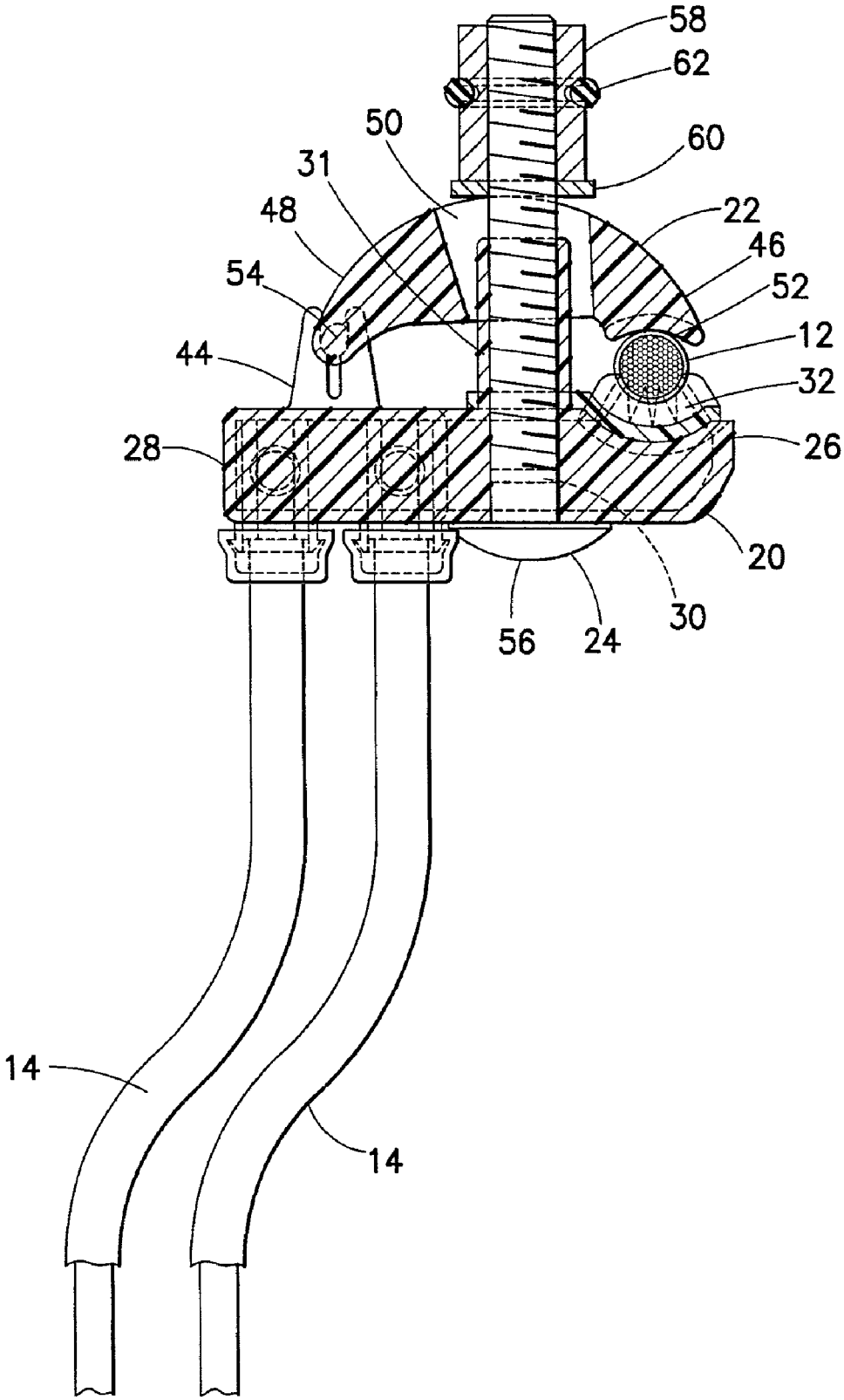
FIG. 3 is a cross sectional view taken along line 3-3 of FIG. 1.
Figure 6:
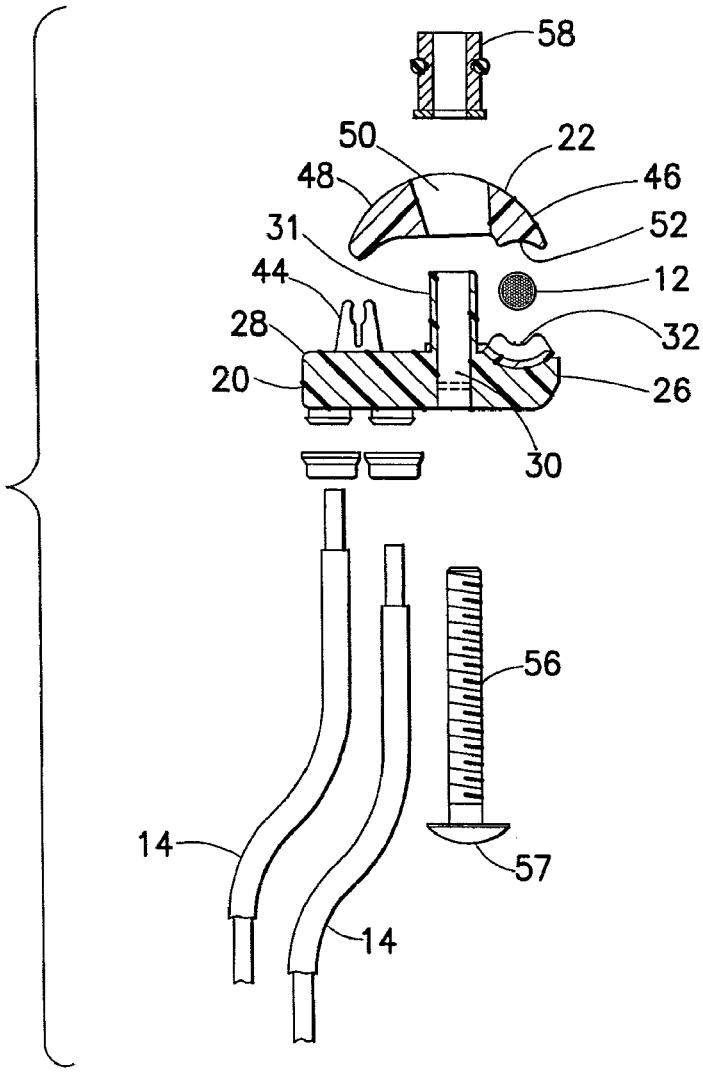
FIG. 6 is an exploded cross sectional view taken along line 6-6 of FIG. 5.

The second member 22 is preferably a one piece member, such as made of metal for example. The second member 22 comprises a first end 46, a second end 48 and a hole 50 in a middle section. The first end 46 has a bottom side with a conductor contact surface 52. The second end 48 has pivot posts 54 which extend laterally outward from opposite sides of the second end 48. The hole 50 has a general oval shape when viewed from above, but a funnel shape when viewed in cross section as seen in FIGS. 3 and 6.

The compression connector 24 comprises a bolt 56 and a fastener 58. The bolt 56 has a head 57 located on the bottom side of the first member 20. The bolt 58 extends through the hole 30. The fastener 58 is screwed onto the bolt 56. The fastener 58 has a flat washer 60 and an O-ring friction member 62. The bolt 56 extends through the hole 50. A portion of the post 31 having the hole 30 extends into the hole 50. The flat washer 60 contacts the top surface of the second member 22 at lateral sides of the top of the hole 50.

The pivot posts 54 are located in respective ones of the receiving pivot slots of the pivot posts 44. The pivot posts 44, 54 form a rotating pivot which is spaced from the compression connector 24 and the second connection section formed at the fasteners 64.

The main conductor 12 is captured between the surface 52 and the channel having the teeth 32. When the nut 58 is tightened on the bolt 56, the main conductor 12 is pressed into the teeth 32 of the plates 38 by the second member 22. The teeth 32 pierce through the insulation 18 and make electrical contact with the conductor core 16 of the main conductor 12. Thus, the plates 38 are electrically connected to the main conductor 12. The hole 50 provides sufficient spacing for the post 31 to allow pivotal movement of the second member 22 on the first member 20 as the fastener 58 is being tightened on the bolt 56.

The connector 10 includes threaded fasteners 64, such as bolts. The fasteners 64 are threaded into the holes 36. Ends of the tap conductors 14, having their insulation 18 removed at those ends, are inserted into the holes 34. The fasteners 64 contact the ends of the tap conductors 14 and press the ends against the outward facing lateral sides of the metal plates 38. Thus, this forms a mechanical gripping of the ends of the conductors 14 in the holes 34, and electrical connection of the tap conductors 14 to the main conductor 12 via the plates 38.

Figure 7:
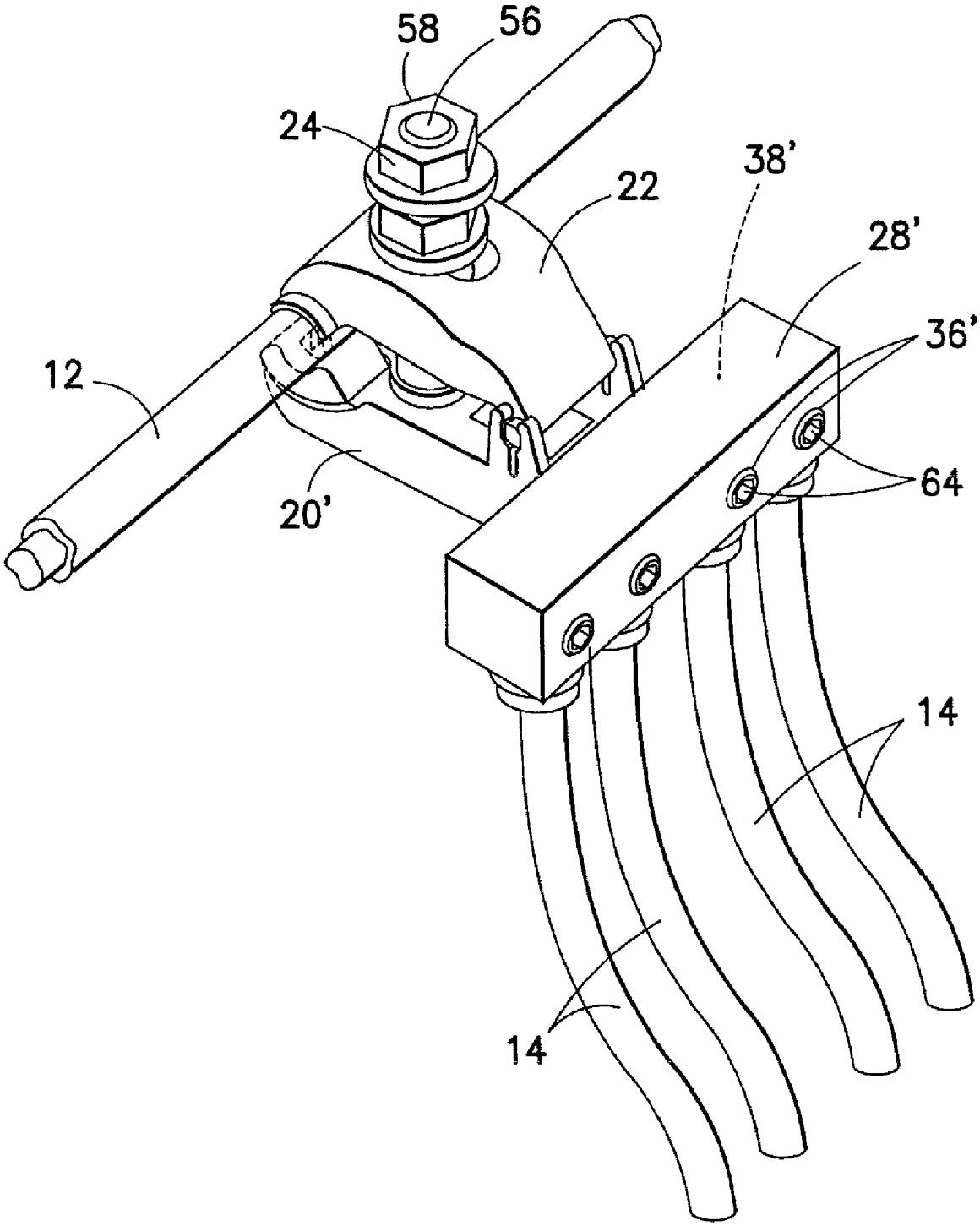
FIG. 7 is a perspective view of another alternate embodiment of the invention.
Figure 8:
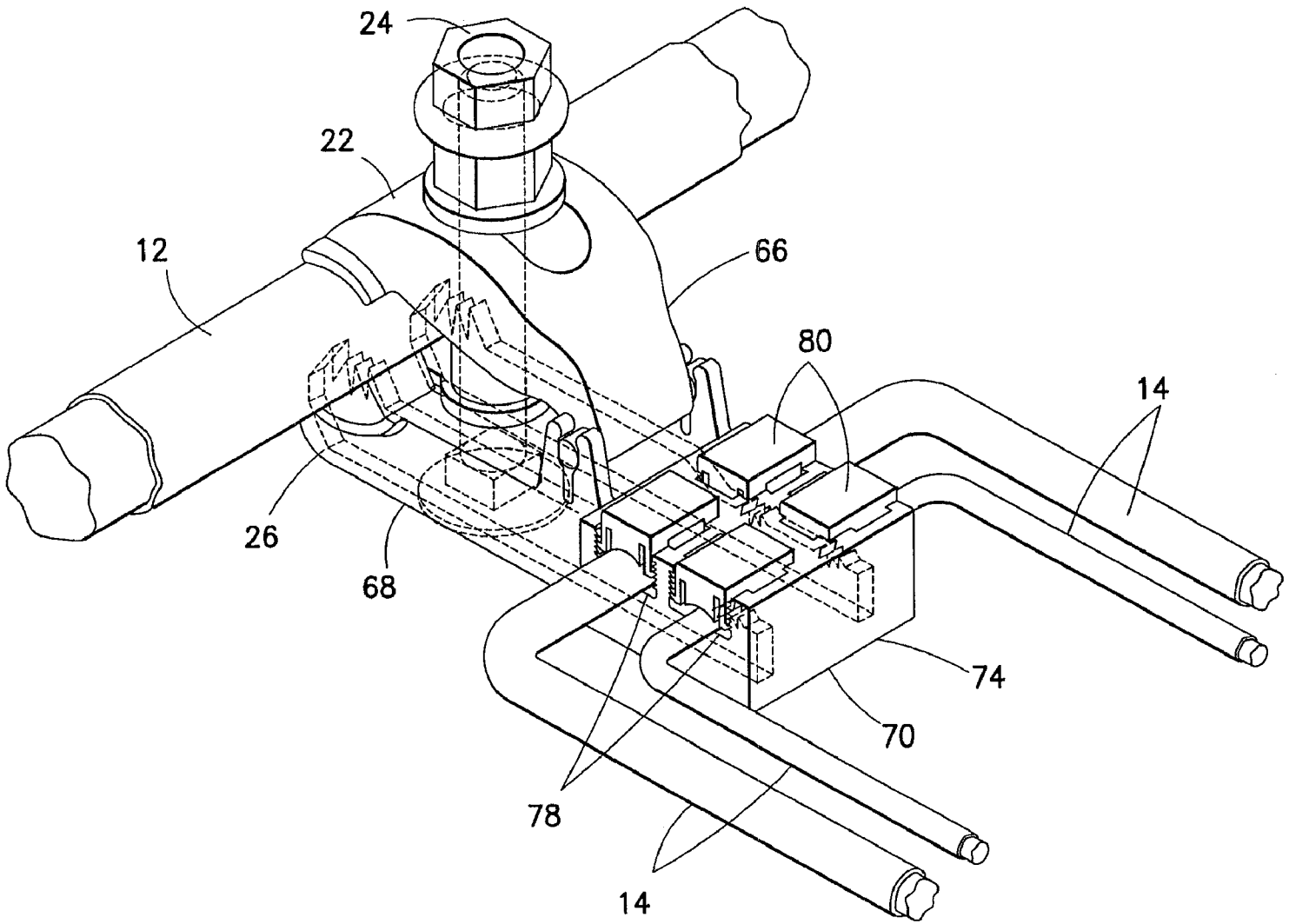
FIG. 8 is a perspective view of another alternate embodiment of the invention.
Figure 9:
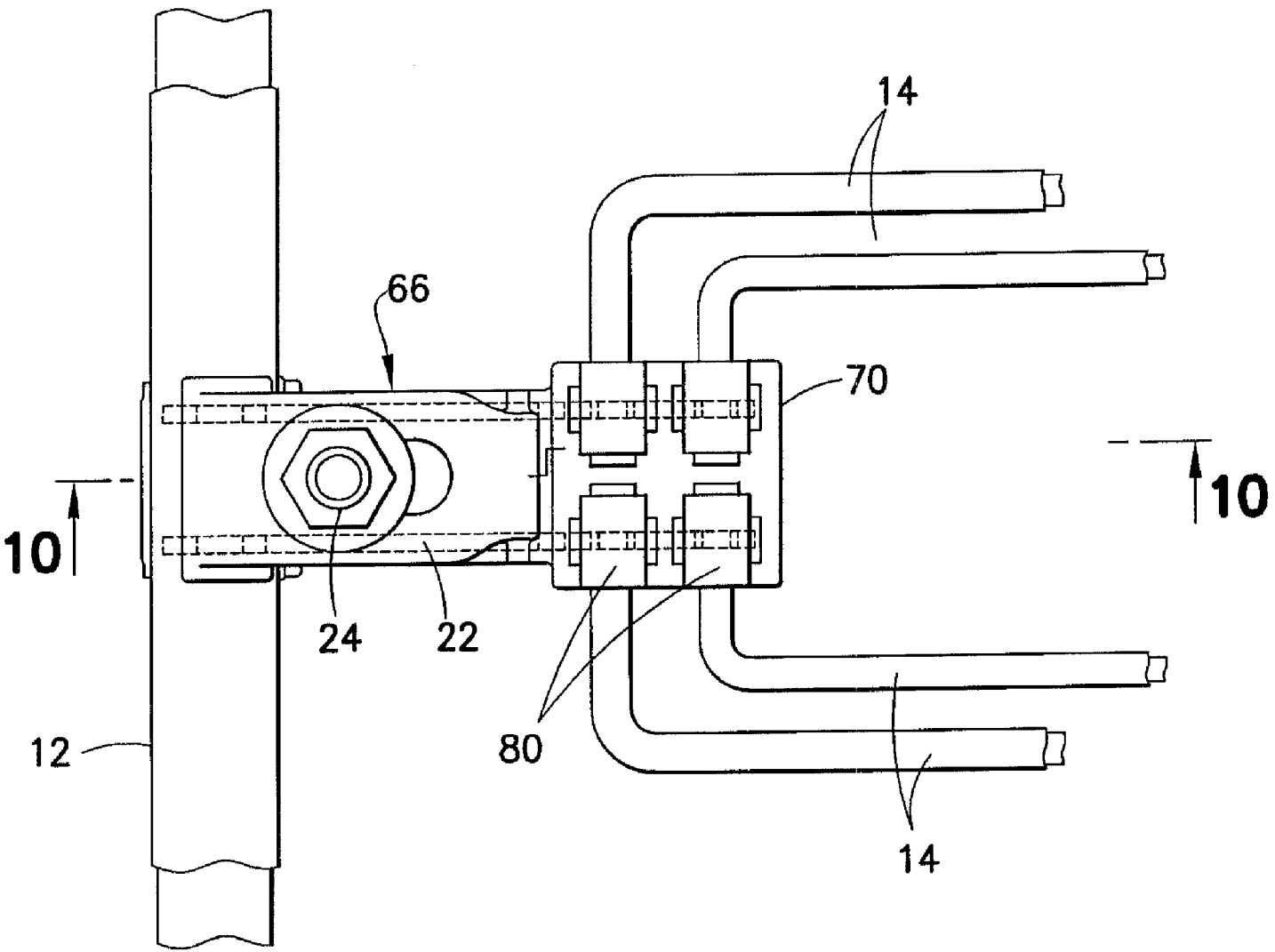
FIG. 9 is a plane top view of the electrical connector and electrical conductors shown in FIG. 8.
Figure 10:
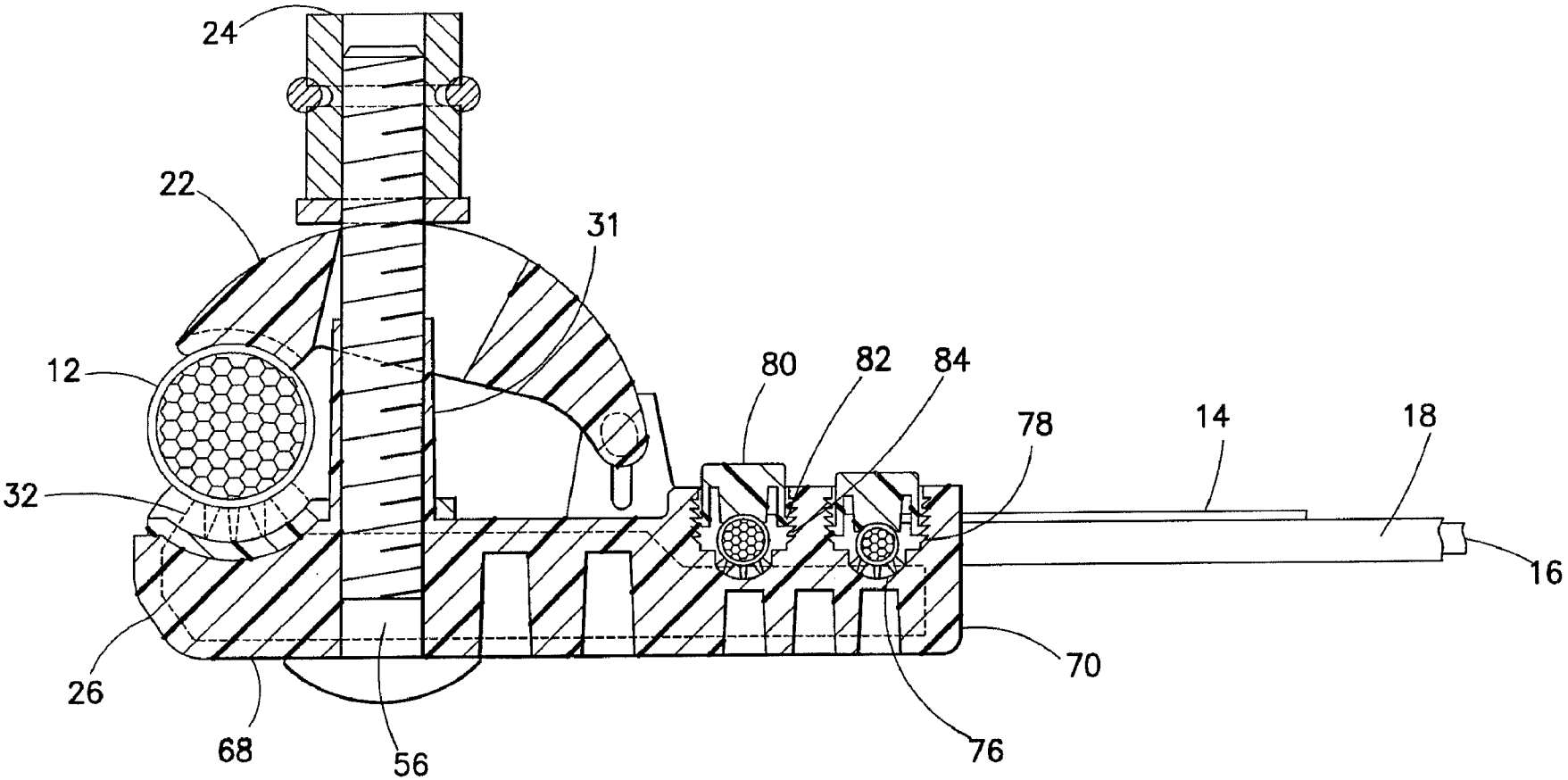
FIG. 10 is a cross sectional view taken along line 10-10 in FIG. 9.
Figure 11:
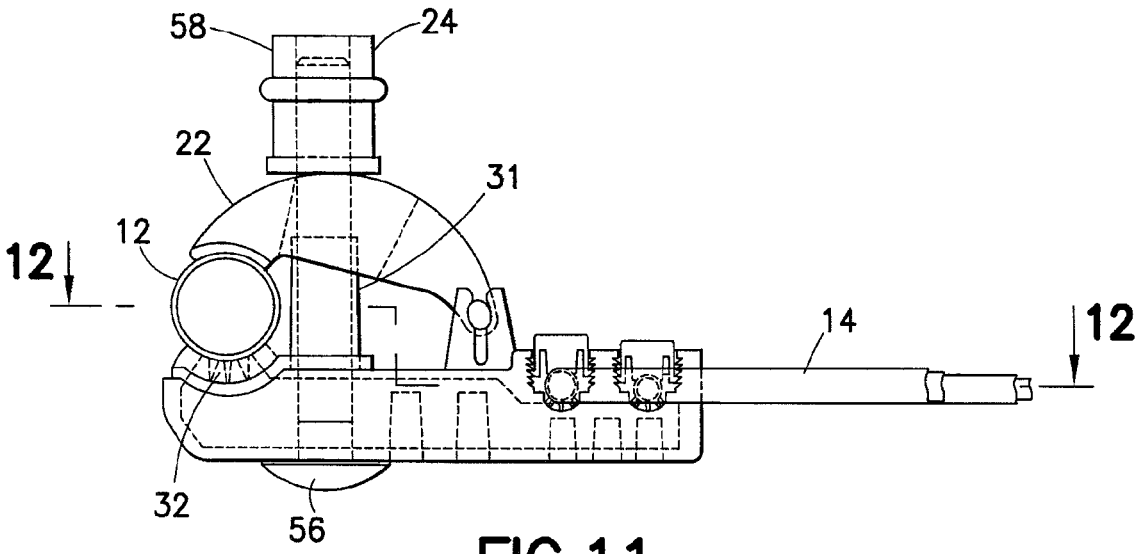
FIG. 11 is a side view of the electrical connector and electrical conductors shown in FIG. 8.
Figure 12:
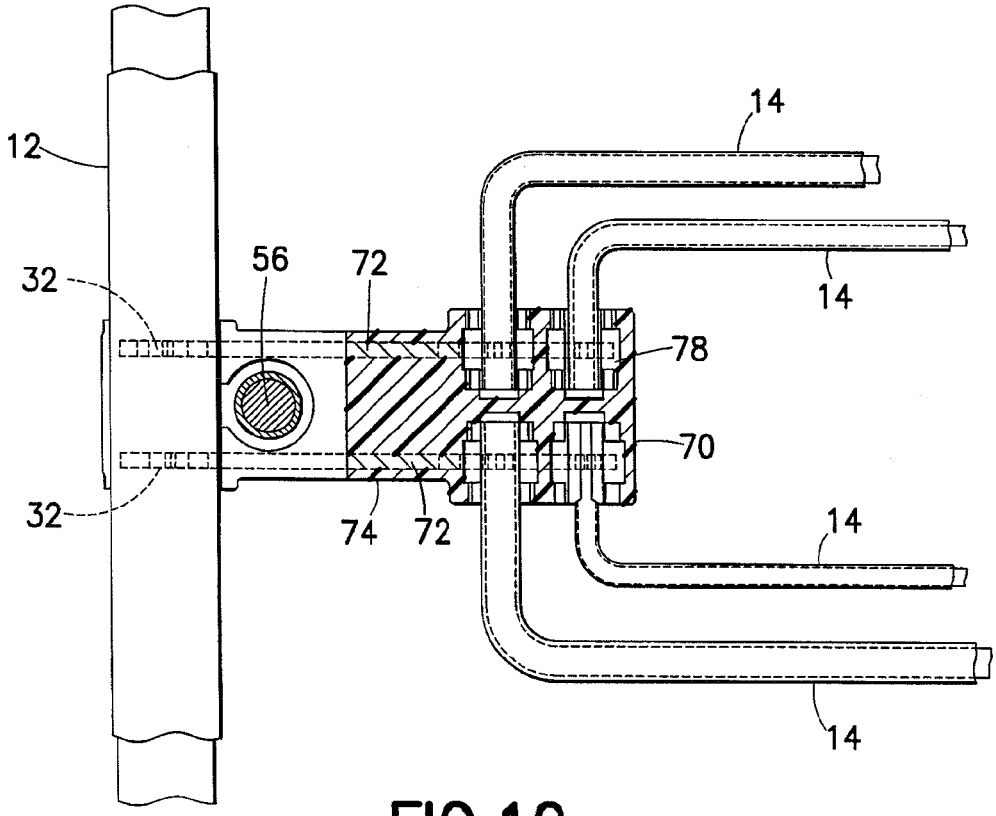
FIG. 12 is a cross sectional view taken along line 12-12 in FIG. 11.
Figure 13:
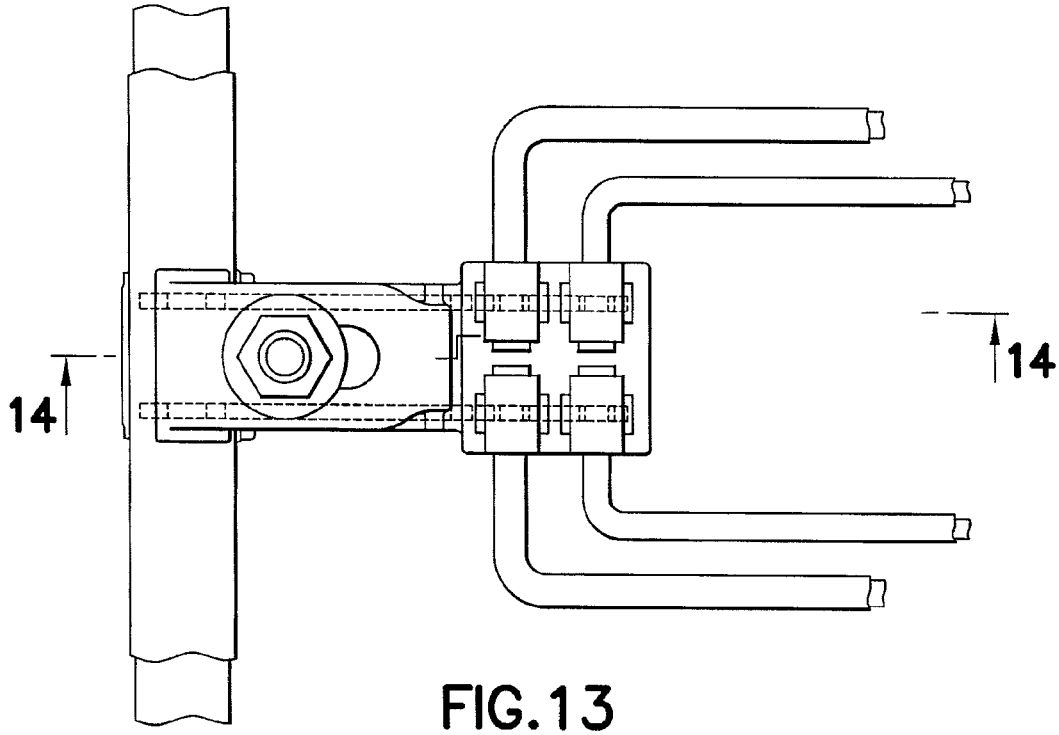
FIG. 13 is a plane top view of another alternate embodiment of the invention.
Figure 21:
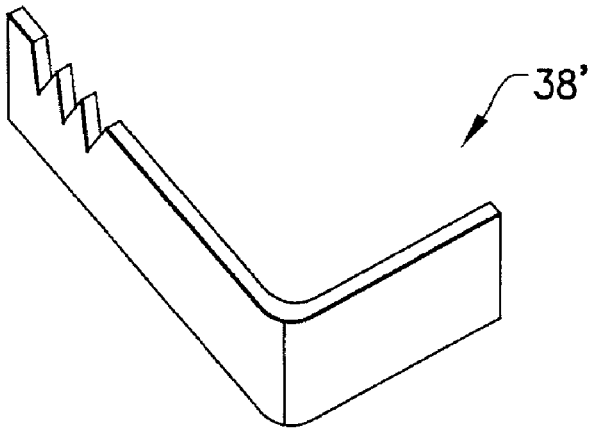
FIG. 21 is a perspective view of one of the metal plates used in the connector shown in FIG. 7.

Referring also to FIG. 7, an alternate embodiment of the electrical connector is shown. In the embodiment shown in FIGS. 1-6, the second end 28 and tap conductor receiving holes 34 where arranged in an array of four 2-by-2 holes. In this embodiment, the electrical connector has a first member 20', the second member 22 and the connector 24. The first member 20' is identical to the first member 20, but it has a second end 28' which has four tap conductor receiving holes arranged in an array as a series in line with each other. The threaded holes 36' for the fasteners 64 all extend into a same side of the second end 28'. The first end of the plates 38' have the teeth 32 (see FIG. 3), and the opposite second ends of the plates 38' have bent sections for the fasteners 64 to press the conductors 14 against. FIG. 21 shows an example of one of the plates 38'.

Referring also to FIGS. 8-14 another alternate embodiment of the invention is shown. In this embodiment the electrical connector 66 has the same second member 22 and fastener 24, but a different first member 68. The first member 68 has the first end 26 and post 31 with the hole 30 in the middle section.

The first member 68 has two metal plates 72 and the overmolded plastic housing or body 74. Each metal plate 72 has a first end with the teeth 32 at the first end 26 and a second end having two sets of teeth 76. The teeth 76 are sized and shaped to pierce through the insulation 18 of the tap conductors 14 to electrically and mechanically connect with the conductive cores 16 of the tap conductors 14. The body 74 has slots 78 extending inward from the lateral and top sides of the body 74. The metal plates 72 are located in the slots 78. Thus, the tap conductors 14 can be inserted into the slots 78 from a top side of the body 74, into the teeth 76, and extend out lateral sides of the body. Caps 80 can be used to cover the top sides of the slots 78. The caps are shown connected to the second end 70' of the first member by living hinges. However, the caps 80 could be separate members. The caps 80 can be used to push the tap conductors 14 into the teeth 76. In this embodiment the caps 80 have snap-lock latches 82 which can engage latch teeth 84 in the slots 78 to retain the caps 80. The latch teeth 84 extend downward for a distance to allow the attachment of the caps 80 to be range taking for different size conductors 14. For example, FIGS. 8-14 show different size diameter conductors 14. The arrangement of the teeth 76 is also range taking to enable use with the different size diameter conductors 14. Thus, the teeth 76 are provided for piercing through insulation 18 for connection to the tap conductors 14. This allows connection with the tap conductors 14 without having to first remove the insulation 18 from the ends of the conductors 14 as is done in the first and second embodiments described above.

Figure 14:
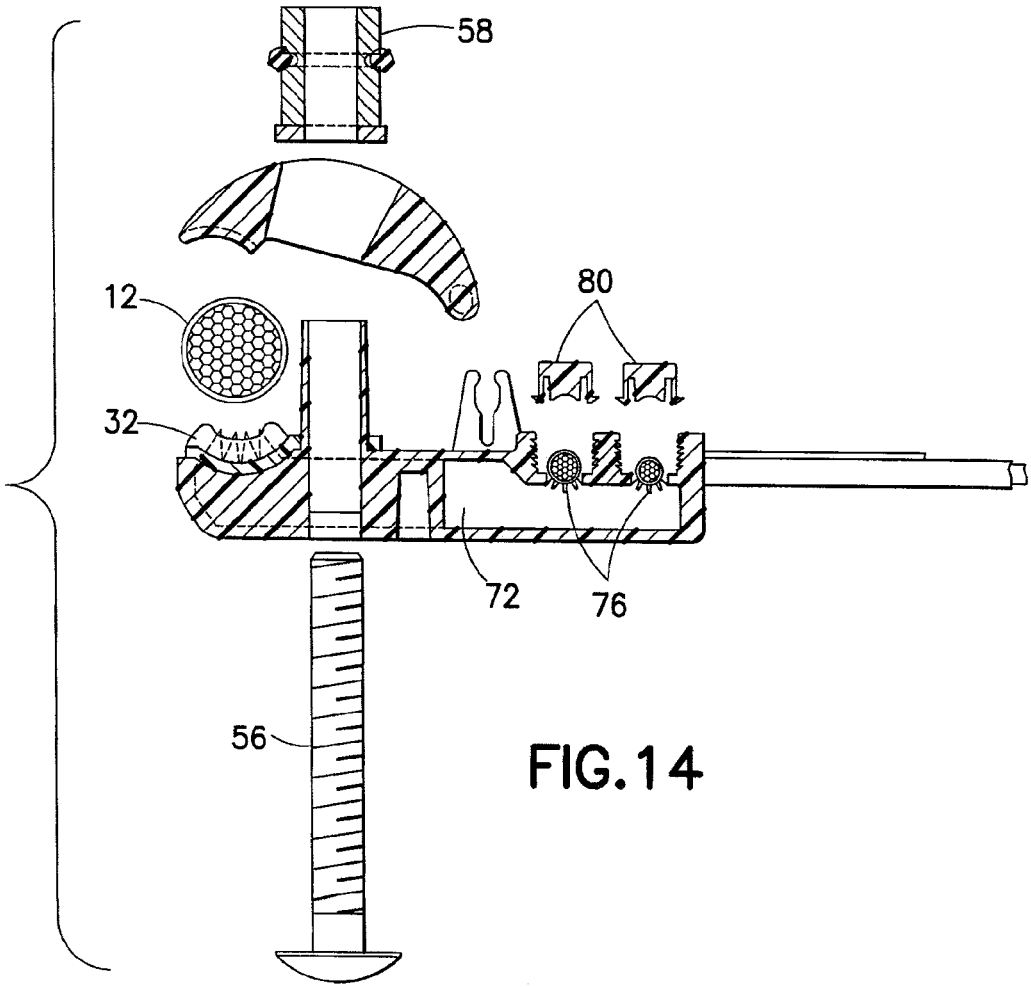
FIG. 14 is an exploded cross sectional view of the electrical connector and electrical conductors shown in FIG. 13.
Figure 15:
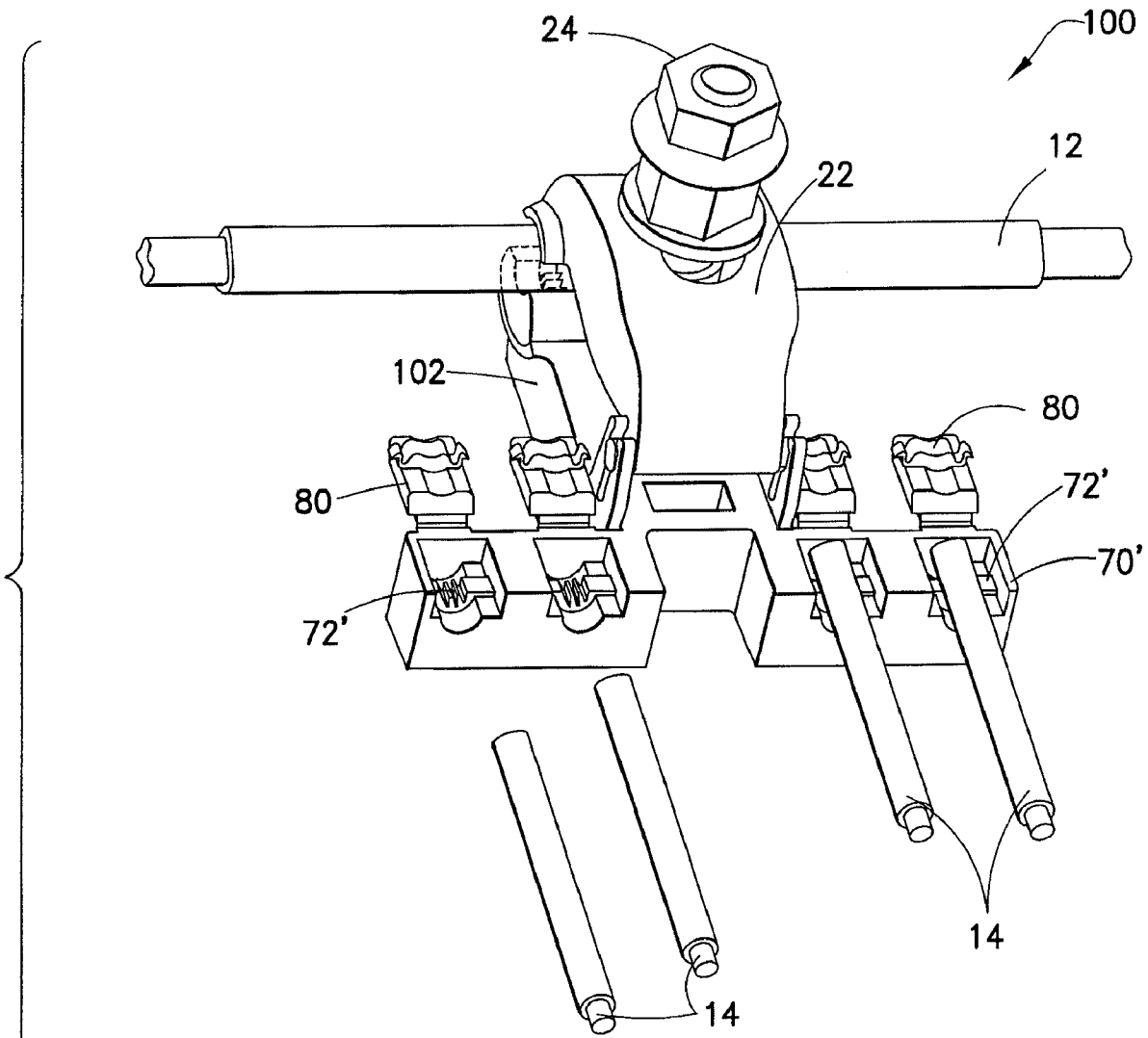
FIG. 15 is a perspective view of another alternate embodiment of the invention.
Figure 16:
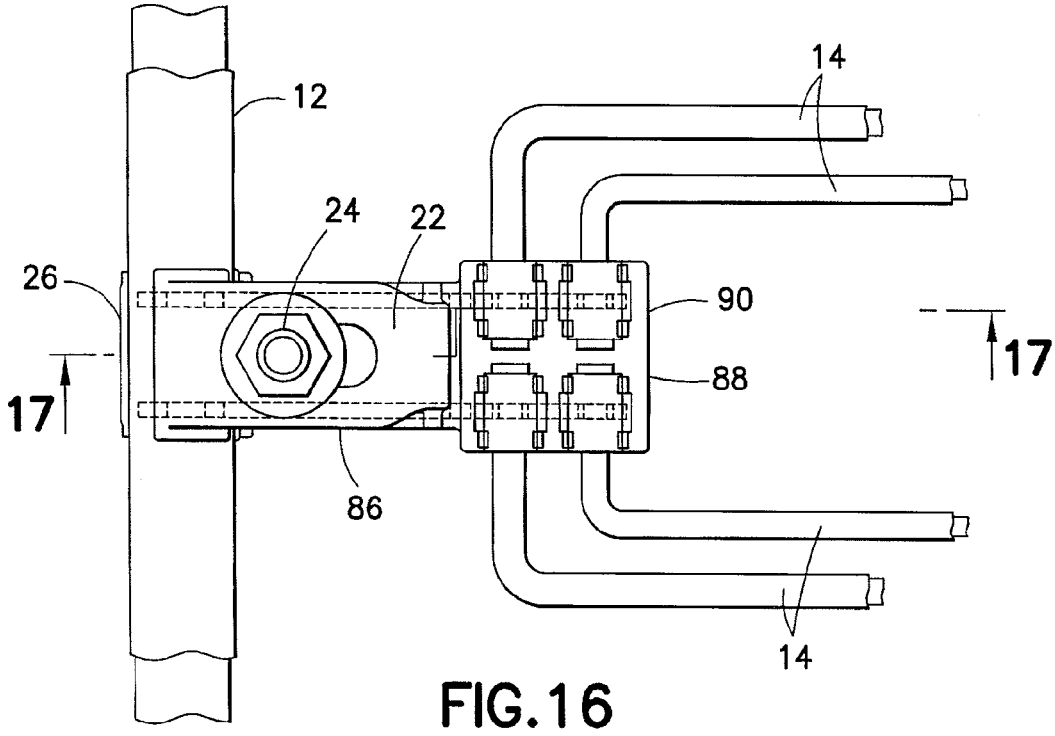
FIG. 16 is a plane top view of another alternate embodiment of the invention.
Figure 17:
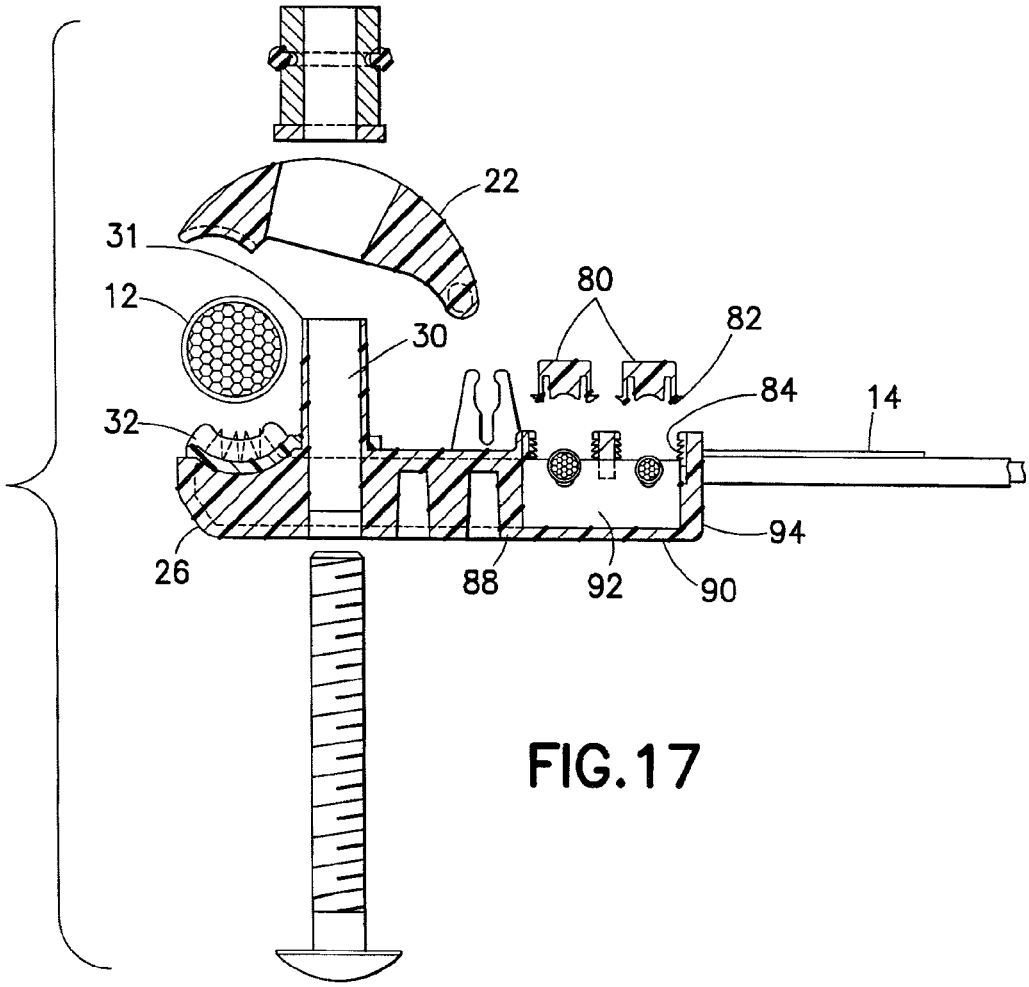
FIG. 17 is an exploded cross sectional view taken along line 17-17 in FIG. 16.
Figure 19:
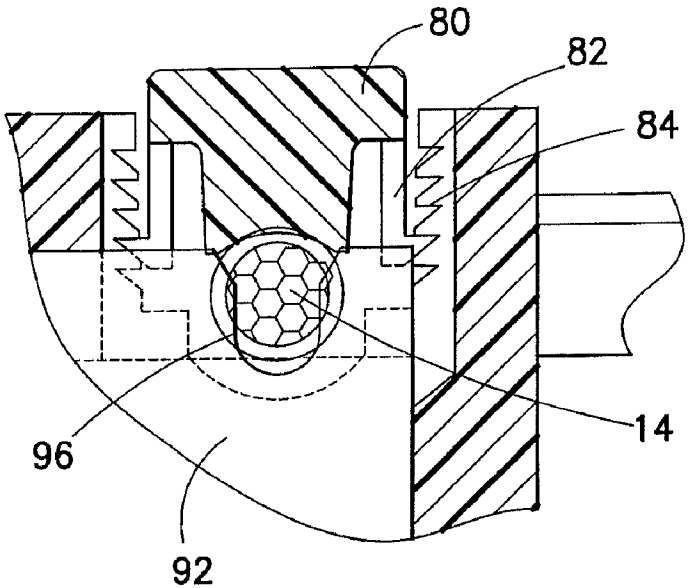
FIG. 19 is an enlarged view of a section of FIG. 18.
Figure 18:
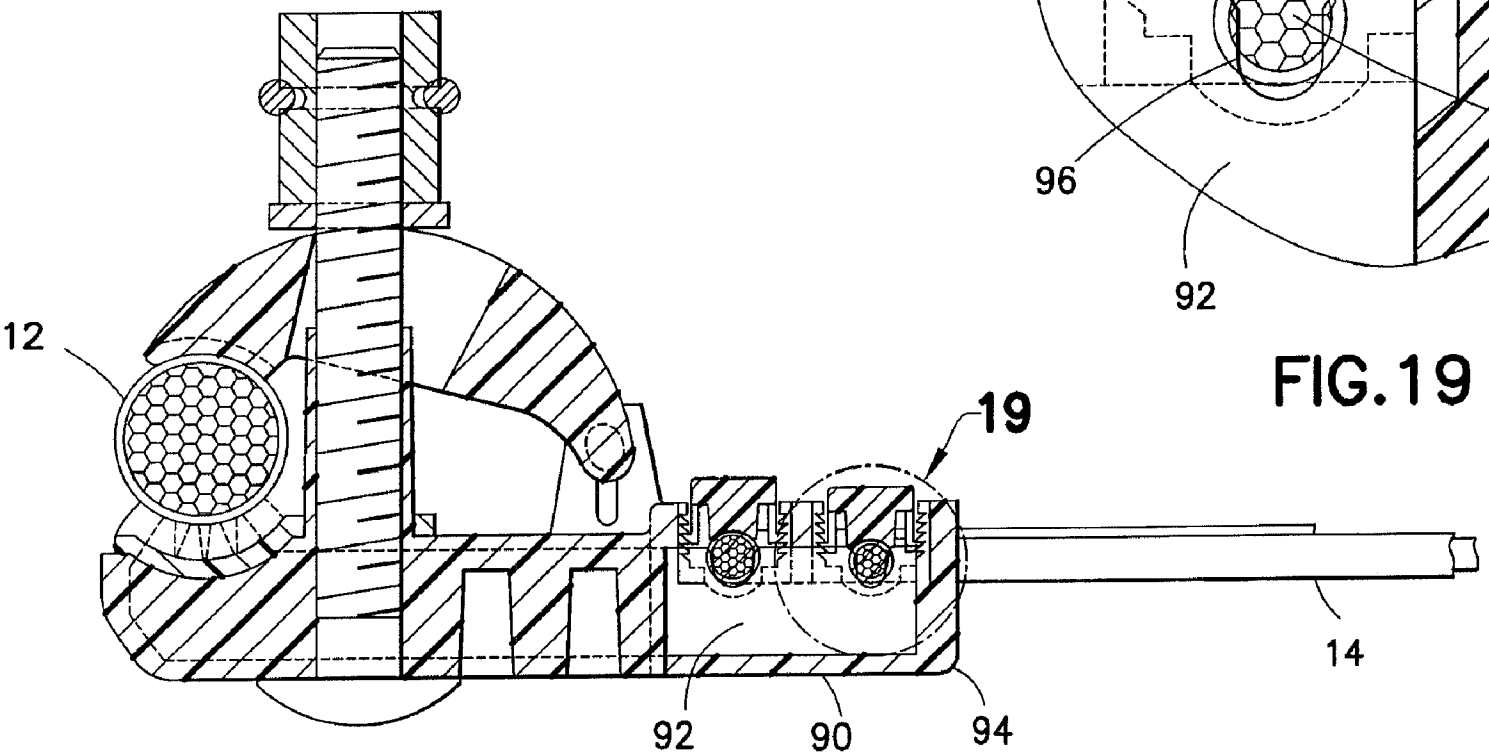
FIG. 18 is a cross sectional view similar to FIG. 17, but showing the members assembled.

Referring also to FIG. 15, an alternate embodiment of the electrical connector 100 is shown. The electrical connector 100 includes a first member 102, the second member 22 and the connector 24. The first member 102 is identical to the first member 68 except for its second end. In the embodiment shown in FIGS. 8-14, the second end 70 and tap conductor receiving slots 78 where arranged in an array of 2-by-2 slots. In this embodiment, the second end 70' has four tap conductor receiving slots arranged in an array as a series in line with each other. The second end 70' is arranged as two spaced block sections to save material. The tap conductors 14 can all exit a same side of the second end 70'. The second ends of the metal plates 72', thus, have a bent or "L" shape as opposed to the straight shape of the second ends of the metal plates 72.

Figure 22:
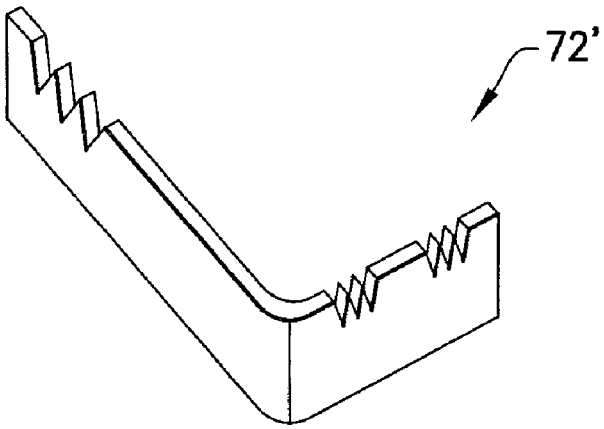
FIG. 22 is a perspective view of one of the metal plates used in the connector shown in FIG. 15.

However, each metal plate 72' has the teeth 76 (see FIG. 14 for the tap conductors 14). FIG. 22 shows an example of one of the plates 72'.

Referring also to FIGS. 16-19 another alternate embodiment of the invention is shown. In this embodiment the electrical connector 86 has the same second member 22 and fastener 24, but a different first member 88. The first member 88 has the first end 26 and post 31 with the hole 30 in the middle section. The second end 90 of the first member 88 is configured with insulation displacement areas for connection to the tap conductors 14. This allows connection with the tap conductors 14 without having to first remove the insulation 18 from the ends of the conductors as is done in the first embodiment described above.

The first member 88 has two metal plates 92 and the overmolded plastic housing or body 94. Each plate 92 has a first end with the teeth 32 at the first end 26 and a second end having two sets of insulation displacement connections (IDC) 96. The IDCs 96 are sized and shaped to slice through opposite side of the insulation 18 of the tap conductors 14 to electrically and mechanically connect with the conductive cores 16 of the tap conductors 14. The body 94 has slots 98 extending inward from the lateral and top sides of the body 94. The IDCs are located in the slots 98. Thus, the tap conductors 14 can be inserted into the slots 98 from a top side of the body 94, into the IDCs, and extend out lateral sides of the body. Caps 80 can be used to cover the top sides of the slots 98. The caps 80 can be used to push the tap conductors 14 into the IDCs. In this embodiment the caps 80 have latches 82 which can engage latch teeth 84 in the slots 78 to retain the caps 80.

Figure 20:
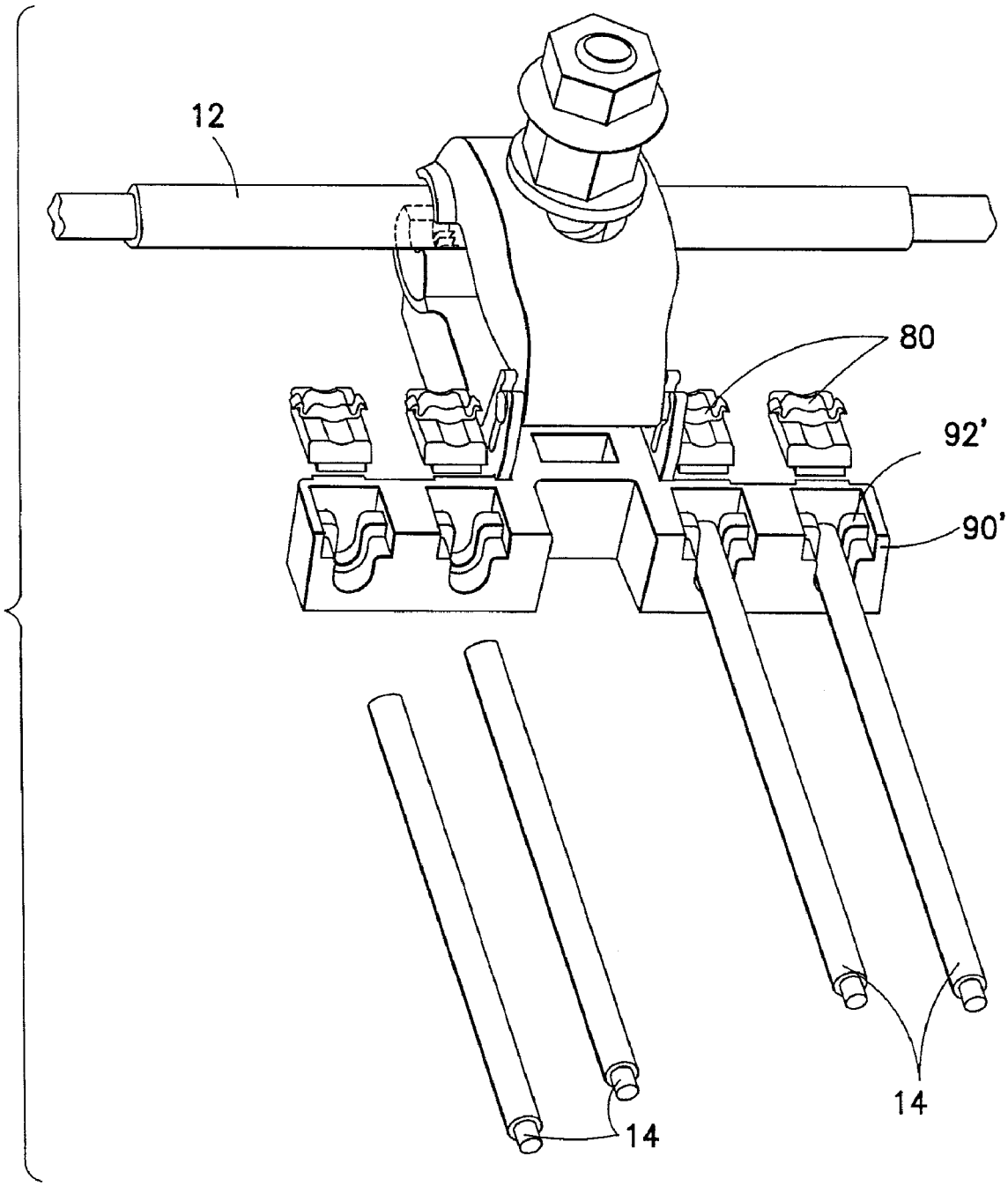
FIG. 20 is a perspective view of another embodiment of the invention.
Figure 23:
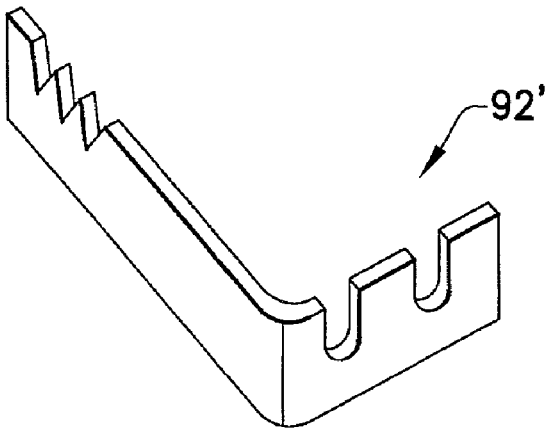
FIG. 23 is a perspective view of one of the metal plates used in the connector shown in FIG. 20.

Referring also to FIG. 20, an alternate embodiment of the connector is shown. In the embodiment shown in FIGS. 16-19, the second end 90 and tap conductor receiving slots 98 where arranged in an array of 2-by-2 slots. In this embodiment, the second end 90' has four tap conductor receiving slots arranged in an array as a series in line with each other. The second end 90' is arranged as two spaced block sections to save material. FIG. 23 shows an example of one of the plates 92' used in the connector. The tap conductors 14 can all exit a same side of the second end 90'.

Embodiments of the invention allow a common upper connector member, such as 22 for example, to be used with a variety of different lower connector members, such as 20, or 20' or 68 for example. Even though an embodiment of the invention can use two connector parts (20 and 22 for example) to clamp onto a first conductor, one of these connector parts (22 for example) is not used to connector to the second conductors 14. The wire connections for the second conductors 14 are merely with the first connector part (20 for example).

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical connector comprising:

a first connection section adapted to connect to a first electrical conductor; and a second connection section adapted to connect to a second electrical conductor, wherein the first and second connection sections comprise a first member, a second member and a compression member for comprising the second member towards the first member, wherein the second member is pivotably connected to the first member at a rotating pivot which is spaced from the compression member and the second connection section, where the compression member comprises a bolt, and where the bolt extends through holes in the first and second members.

2. An electrical connector as in claim 1 wherein the first member comprises a second end at the second connection section, and wherein the rotating pivot is located on a pivot post extending from the second end of the first member.

3. An electrical connector as in claim 1 wherein the first member comprises a first metal plate with a first end having insulation piercing teeth, wherein the teeth are adapted to pierce into the first electrical conductor, wherein the first member comprises an overmolded polymer body overmolded onto the metal plate, wherein the first member comprises a second metal plate with a first end having insulation piercing teeth, wherein the teeth of the second metal plate are adapted to pierce into the first electrical conductor, and wherein the first ends of the first and second metal plates are generally spaced and parallel to each other, wherein the metal plate comprises an opposite second end at the second connection section, wherein the second end is adapted to directly connect to the second electrical conductor, wherein the first member comprises a second end at the second connection section, and wherein the rotating pivot is located on a pivot post extending from the second end of the first member, and wherein the second connection section comprises the first member comprising at least four second electrical conductor receiving areas configured to separately receive at least four second electrical conductors.

4. An electrical connector as in claim 1 wherein the first member comprises a first metal plate with a first end having insulation piercing teeth, wherein the teeth are adapted to pierce into the first electrical conductor.

5. An electrical connector as in claim 4 wherein the first member comprises an overmolded polymer body overmolded onto the metal plate.

6. An electrical connector as in claim 4 wherein the metal plate comprises an opposite second end at the second connection section, wherein the second end is adapted to directly connect to the second electrical conductor.

7. An electrical connector comprising:

a first connection section adapted to connect to a first electrical conductor; and a second connection section adapted to connect to a second electrical conductor, wherein the first and second connection sections comprise a first member, a second member and a compression member for compressing the second member towards the first member, wherein the second member is pivotably connected to the first member at a rotating pivot which is spaced from the compression member and the second connection section, wherein the first member comprises a first metal plate with a first end having insulation piercing teeth, wherein the teeth are adapted to pierce into the first electrical conductor, wherein the first member comprises a second metal plate with a first end having insulation piercing teeth, wherein the teeth of the second metal plate are adapted to pierce into the first electrical conductor, and wherein the first ends of the first and second metal plates are generally spaced and parallel to each other.

8. An electrical connector comprising:

a first connection section adapted to connect to a first electrical conductor; and a second connection section adapted to connect to a second electrical conductor, wherein the first and second, connection sections comprise a first member, a second member and a compression member for compressing the second member towards the first member, wherein the second member is pivotably connected to the first member at a rotating pivot which is spaced from the compression member and the second connection section, wherein the first member comprises a first metal plate with first end having insulation piercing teeth, wherein the teeth are adapted to pierce into the first electrical conductor, wherein the metal plate comprises an opposite second end at the second connection section, wherein the second end is adapted to directly connect to the second electrical conductor, wherein the second connection section comprises a fastener connected to the first member and adapted to clamp the second electrical conductor against the second end of the metal plate.

9. An electrical connector as in claim 8 wherein the second connection section comprises a fastener plate with a threaded hole, wherein the fastener is threadingly mounded in the threaded hole.

10. An electrical connector comprising:

a first connection section adapted to connect to a first electrical conductor; and a second connection section adapted to connect to a second electrical conductor, wherein the first and second connection sections comprise a first member, a second member and a compression member for compressing the second member towards the first member, wherein the second member is pivotably connected to the first member at a rotating pivot which is spaced from the compression member and the second connection section, wherein the first member comprises a first metal plate with a first end having insulation piercing teeth, wherein the teeth are adapted to pierce into the first electrical conductor wherein the metal plate comprises an opposite second end at the second connection section, wherein the second end is adapted to directly connect to the second electrical conductor, wherein the second end of the metal plate comprises insulation piercing teeth configured to pierce through insulation of the second electrical conductor.

11. An electrical connector as in claim 10 wherein the second connection section comprises a cap adapted to be snap-lock connected to the first member and adapted to push the second electrical conductor against the teeth at the second end of the metal plate.

12. An electrical connector comprising:

a first connection section adapted to connect to a first electrical conductor; and a second connection section adapted to connect to a second electrical conductor, wherein the first and second connection sections comprise a first member, a second member and a compression member for compressing the second member towards the first member, wherein the second member is pivotably connected to the first member at a rotating pivot which is spaced from the compression member and the second connection section, wherein the first member comprises a first metal plate with a first end having insulation piercing teeth, wherein the teeth are adapted to pierce into the first electrical conductor, wherein the metal plate comprises an opposite second end at the second connection section, wherein the second end is adapted to directly connect to the second electrical conductor, wherein the second end of the metal plate comprises an insulation displacement connection (IDC) slot configured to slice through insulation of the second electrical conductor.

13. An electrical connector as in claim 12 wherein the second connection section comprises a cap adapted to be snap-lock connected to the first member and adapted to push the second electrical conductor into the IDC slot at the second end of the metal plate.

14. An electrical connector comprising:

a first connection section adapted to connect to a first electrical conductor; and a second connection section adapted to connect to a second electrical conductor, wherein the first and second connection sections comprise a first member, a second member and a compression member for compressing the second member towards the first member, wherein the second member is pivotably connected to the first member at a rotating pivot which is spaced from the compression member and the second connection section, wherein the second connection section comprises the first member comprising at least four second electrical conductor receiving areas configured to separately receive at least four second electrical conductors.

15. An electrical connector as in claim 14 wherein the at least four second electrical conductor receiving areas are arranged in a single row.

16. An electrical connector as in claim 14 wherein the at least four second electrical conductor receiving areas are arranged in a array of at least two spaced rows.

17. An electrical connector as in claim 16 wherein the at least two spaced rows are located on opposite lateral sides of the first member.

18. An electrical connector comprising:

a first member comprising a first end and a second end, wherein the first member comprises a metal plate with insulation piercing teeth at the first end for connection to a first conductor and a second conductor connection section at the second end, wherein the second end comprises a pivot post extending from the second end;

a second member having a first end rotatably connected to the first member on the pivot post, wherein the second member has an opposite second end adapted to press the first conductor into the teeth of the metal plate; and a compression fastener spaced from the pivot post and the first and second ends of the first and second members, where the compression fastener is configured to compress the second member towards the first member with the second member rotatably pivoting on the pivot post.

* * * * *